United States Patent [19]

Citrone et al.

[11] 4,282,109

[45] Aug. 4, 1981

[54] AQUEOUS HYPOCHLORITE SOLUTIONS

[75] Inventors: Anthony M. Citrone, Chinnor; Stephen B. Pontin, High Wycombe, both of England

[73] Assignee: Reckitt & Colman Products Limited, England

[21] Appl. No.: 149,974

[22] Filed: May 15, 1980

[30] Foreign Application Priority Data

May 30, 1979 [GB] United Kingdom ..... 18721/79

[51] Int. Cl.[3] ..... C11D 7/54

[52] U.S. Cl. ..... 252/102; 252/95; 252/98; 252/99; 252/103

[58] Field of Search ..... 252/102, 103, 95, 98, 252/99

[56] References Cited

U.S. PATENT DOCUMENTS

| | | | |
|---|---|---|---|
| 3,560,389 | 2/1971 | Hunting | 252/103 X |
| 3,684,722 | 8/1972 | Hynam et al. | 252/102 X |
| 3,876,551 | 4/1975 | Lauder et al. | 252/103 X |

FOREIGN PATENT DOCUMENTS

| | | | |
|---|---|---|---|
| 1466560 | 3/1977 | United Kingdom | 252/102 |

*Primary Examiner*—Mayer Weinblatt

*Attorney, Agent, or Firm*—Bacon & Thomas

[57] ABSTRACT

The invention provides a thickened bleach composition including an aqueous solution of alkali metal hypochlorite, nd a thickening amount of a surfactant blend comprising:

(a) an amine oxide of formula:

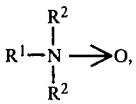

wherein $R^1$ is an optionally branched chain alkyl group containing 10 to 18 carbon atoms; $R^2$ is a lower alkyl group containing up to 3 carbon atoms, and (b) an alkali metal alkyl sulphate of formula: $R^3—O—SO_3M$, wherein $R^3$ is an optionally branched chain alkyl group containing 8 to 12 carbon atoms and M is lithium, sodium or potassium.

The proposed composition affords a measure of control over the physical properties of the composition, including the Cloud Point, to assist the composition in maintaining its desired cleansing properties even after prolonged storage.

26 Claims, No Drawings

AQUEOUS HYPOCHLORITE SOLUTIONS

This invention relates to thickened aqueous alkali metal hypochlorite bleach compositions and methods for preparing such compositions.

Bleach compositions comprising alkali metal hypochlorites in aqueous solution are known and are useful inter alia for cleaning hard surfaces. The viscosity of such aqueous hypochlorite solutions is from 8 to 11 centipoise depending upon the strength of the solution. These aqueous hypochlorites tend to flow off sloping surfaces too quickly to ensure efficacious cleansing. Hence, a requirement has arisen for less labile, that is more viscous compositions for general use.

Thickened aqueous hypochlorite solutions of viscosity substantially greater than 8 to 11 centipoise have been proposed but most proposals suffer a disadvantage of phase instability at usage temperatures depending upon the precise composition.

In this specification, the temperature at which a composition suffers phase separation is referred to as the 'Cloud Point'. For general use a composition should not be subject to temperatures exceeding the Cloud Point otherwise the composition may suffer a phase separation. Usually, such phase separation is reversible when the temperature falls below the Cloud Point, however, there is no guarantee that the reversibility will be perfect in every case.

British Specification No. 1329086 discloses that on testing many thickener materials that might be expected to increase the viscosity of aqueous hypochlorite solutions, no thickening occurrs and at best the materials have unsatisfactory thickening properties especially on storage. The specification suggests that satisfactory thickened aqueous alkali metal hypochlorite compositions result only from admixture of aqueous hypochlorites with a specific combination of certain carefully selected hypochlorite-soluble amine oxides or certain betaines and narrowly specified alkali metal salts of $C_8$ to $C_{18}$ fully saturated fatty acids, that is soaps. Since soaps are an essential constituent of these thickened compositions obvious disadvantages can arise with their ordinary use in 'hard'-water districts.

In British Specification No. 1466560 thickened aqueous alkali metal hypochlorite compositions are disclosed in which the thickening is imparted by admixture of hypochlorite solutions with combinations of certain sarcosinate or tauride surfactants with one or more of the surfactants: soaps, certain quaternary ammonium compounds, amine oxides, betaines and alkanolamides. These carefully selected blends which may include up to six different chemical entities represent more or less complicated mixtures and those including soaps will in use be subject to the abovementioned disadvantage in 'hard'-water districts. Further, the presence of a sarcosinate or tauride surfactant is essential to the thickening effect.

On the other hand U.S. Pat. No. 3,876,551 discloses transparent, aqueous hypochlorites solutions containing perfume in which the clarity of solution is achieved by the addition of over 0.15% w/w of the total composition of amine oxides which may have even or odd numbers of carbon atoms in their alkyl groups. The specification is silent on thickening such solutions.

Such compositions, containing up to 10% available chlorine immediately after manufacture, are found to deteriorate upon storage. That is to say on storage over protracted periods in excess of 3 months some loss of chlorine is inevitable from any unthickened or thickened aqueous alkali metal hypochlorite solution. Broadly speaking the higher the original active chlorine content, the more rapid is the deterioration in this respect initially, say, from an original concentration of 10% active chlorine down to about 7.5% active chlorine. Proposals for stabilisation of aqueous hypochlorites have been made, for example in British Specification No. 1282906 which relates to the addition of certain heptonates and boroheptonates for this purpose. However, variations from original viscosity and chlorine content of hypochlorite solutions seem to be to some extent commercially acceptable.

The present invention seeks to provide thickened aqueous alkali metal hypochlorites solutions capable of affording a measure of control over deterioration occasioned by phase instability during storage and which possess the advantage of being substantially equally effacious in use in conjunction with both 'hard' and 'soft' water.

According to the present invention there is provided a thickened bleach composition including an aqueous solution of an alkali metal hypochlorite, and a thickening amount of a surfactant blend comprising:

(a) an amine oxide of formula:

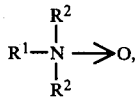

wherein $R^1$ is an alkyl group containing 10 to 18 carbon atoms; $R^2$ is a lower alkyl group containing up to 3 carbon atoms, and (b) an alkali metal alkyl sulphate of formula: $R^3—O—SO_3M$, wherein $R^3$ is an alkyl group containing 8 to 12 carbon atoms and M is lithium, sodium or potassium.

Each of $R^1$, $R^2$ and $R^3$ may be a straight or branched chain which may contain an odd or even number of carbon atoms.

Conveniently, amine oxides and alkali metal alkyl sulphates of mixed chain length may be used. Such materials may contain a predominance of one or more chain lengths.

Preferably, in the amine oxide, $R^2$ is a methyl group and $R^1$ is a $C_{10}$–$C_{18}$ alkyl chain. Conveniently, $R^1$ is a straight or branched chain $C_{12}$–$C_{15}$ alkyl.

Preferably, $R^3$ is a branched chain of 8 carbon atoms, especially the group 2-ethylhexyl.

The weight ratio of amine oxide to alkali metal alkyl sulphate to some extent controls the stability and viscosity developed in the final composition. This ratio is preferably not less than 3:4 and is preferably greater than 13:8. More preferably, the weight ratio is not less than 2:1 and especially greater than or equal to 3:1.

Preferably the ratio does not exceed 12:1 and the preferred broadest ratio range is 3:4 to 12:1.

Preferably, the range of weight ratios is from 7:2 to 12:1, and especially from 4:1 to 10:1.

When an amine oxide with an odd number of carbon atoms in the alkyl group $R^1$, is used, the weight ratio lies at the high end of the range, for example it lies in the range 8:1 to 12:1. When using amine oxides in which $R^1$ is odd, the range 9:1 to 11:1 is preferred, especially the narrower range 46:5 to 48:5.

Contrastingly, when an amine oxide with an even number of carbon atoms in the alkyl group, $R^1$, is used, the weight ratio preferably lies at the low end of the range for example 7:2 to 5:1 and conveniently in the range 4:1 to 5:1. Preferably the range is 4:1 to 23:5 especially 21:5 to 23:5 when using amine oxides in which $R^1$ has an even number of carbon atoms.

The concentration of the surfactant blend is unlikely to exceed about 3% by weight of the total composition on cost grounds and thickening may be achieved in some cases with concentrations as low as 0.25% w/w depending upon the precise chemical nature of the surfactant blend and the abovementioned ratio of its components used. Preferably, the concentration of the surfactant blend is at least 0.4% w/w. Broadly, the surfactant blend may represent 0.7% to 2.0% w/w of the thickened bleach composition. Preferably, the surfactant blend represents from 0.95% to 1.5% w/w of the composition, especially 1.1% to 1.35% w/w of the composition.

When an amine oxide with an odd number of carbon atoms in the alkyl group, $R^1$, is used, the concentration of the surfactant blend is preferably towards the low end of the range, for example 0.95% to 1.5% w/w or more narrowly, 1.1% to 1.5% w/w of the total composition.

Preferably, when using amine oxides in which $R^1$ has an odd number of carbon atoms, the concentration of surfactants is 0.8% to 1.35% especially 0.95% to 1.35% w/w of the total composition.

When an amine oxide with an even number of carbon atoms in the alkyl group is used, the surfactant blend preferably represents 0.75% to 2.00% w/w, especially 0.7% to 2.00% w/w.

Sodium chloride is a usual constituent of industrial sodium hypochlorites and is believed to contribute to the thickening effect of surfactants. Additional sodium chloride may be included and the added sodium chloride may represent up to 5% w/w of the composition making a total of up to 20% w/w of sodium chloride in the thickened composition. Where, for example an amine oxide with an even number of carbon atoms is used, a consequent reduction in the level of surfactant blend is possible. To achieve equivalent viscosity the surfactant blend in some cases is reduced to about 0.25% w/w and the range 0.75% to 1.25% w/w of the bleach composition can be achieved.

As indicated above the viscosity of unthickened alkali metal hypochlorites solution is dependent upon the active chlorine content thereof. Thus unthickened aqueous solutions containing 10% active chlorine had viscosity as measured below of 11 centipoise and at 5.06% active chlorine, a viscosity of 8 centipoise under the same conditions.

Such solutions, when the surfactant blend is added, become noticeably thicker when a viscosity as measured of about 25 centipoise is achieved although there may be some value in solutions of viscosity greater than 15 centipoise. With ordinary concentrations of the surfactant blend, it is unlikely that a viscosity as measured will much exceed about 150 centipoise.

The thickened bleach compositions of the present invention usually have viscosity, as determined with a Brookfield viscometer RVT (SYNCHROLECTRIC—Trade Name) using a number 1 spindle at 50 r.p.m. and 20° C., in the range 35 to 120 cps., preferably 45 to 90 cps., especially the range 60 to 80 cps.

As indicated above Cloud Point is an important guide to the storage stability of thickened hypochlorites solutions. The Cloud Point must be above the ambient temperature prevailing in the locality where the compositions are to be manufactured, stored and used. The greater the difference between such ambient temperature and the Cloud Point the greater the phase-stability of the composition and importantly the wider the range of countries in which the material may be marketed and used. Whilst it is of course possible to produce a composition in accordance with the present invention having Cloud Point which will not be exceeded in any location throughout the World, it is advantageous from cost condiderations alone to formulate compositions for particular countries and having lower Cloud Points that will not be exceeded by the ambient temperature in the location(s) where it is manufactured, stored and used.

Thus it will be seen that a suitable composition needs to be "tailored" to suit the environment(s) in which it is manufactured, marketed and used. Consequently, satisfactory compositions according to this invention may have a different range of constitutions depending on the location(s) of manufacture, marketing and usage.

Broadly, it may be stated that the Cloud Point is substantially higher than the mean winter surface temperature reduced to sea-level and will usually be greater than the maximum summer surface temperature prevailing or likely to prevail during the life of the product in the location where it is manufactured, stored and used.

In the United Kingdom and northern Europe a satisfactory Cloud Point for compositions of the invention is $\geqq 20°$ C. as determined from the mean of the temperature at which turbidity occurs (rising temperature) and the temperature at which a clear point is attained (falling temperature) which are obtained by successively gently heating and cooling a stirred sample maintained in a water-bath. Preferably, for the United Kingdom the Cloud Point is greater than 30° C.

The thickened bleach compositions may be prepared by mixing the components at room temperature preferably in non-metallic apparatus, avoiding contact with metals other than stainless steel.

Two mixing regimens are usable viz:

(1) The required amount of alkali metal hypochlorite is added to water in a container with stirring and any desired additional sodium hydroxide is then added, for example 1–2% w/w sodium hydroxide may be added to improve stability of hypochlorite solutions. The required amount of amine oxide is then added followed by the proper amount of alkali metal alkyl sulphate to give the desired ratio. Finally a hypochlorite-stable perfume may be added if desired. The maximum viscosity is attained after allowing to stand for about 48 hours.

(2) If sodium lauryl sulphate is employed as the alkali metal alkyl sulphate, it has been found preferable firstly to prepare a thickened surfactant blend in aqueous medium by adding the sulphate to the amine oxide in water, followed by homogenisation. The alkali metal hypochlorite is then added with stirring, and followed by such additional sodium hydroxide and sodium chloride as may be desired thereafter; and finally adding perfume as in 1 above.

A suitable colourant may be added, one such being potassium permanganate, but other hypochlorite-stable colourants may be employed.

A perfume or perfume blend may be added if desired provided that it contains no component that reacts with hypochlorite. Perfumes that have been found to be compatible with aqueous hypochlorite are known. For example, the ready solubilised perfumes in the CHLORIFF range marketed by International Flavours and Frangrances, I.F.F. (Great Britain Ltd.), also a range that need to be solubilised in a part of the amine oxide and marketed by Fritzsche-Dodge and Olcott (U.K.) Limited have been found useful.

The invention is further illustrated in the following non-limitative examples in which %ages are by weight of the final composition unless otherwise indicated.

The alkali metal hypochlorite employed is marketed by Ellis & Everard Chemicals and may vary slightly depending upon the factory of origin.

EXAMPLE 1

| | | % age w/w |
|---|---|---|
| Sodium hypochlorite | (available chlorine, 15% w/w; sodium chloride, 14.4% w/w; sodium hydroxide, 0.27% w/w) | 66.67 |
| Sodium hydroxide | (46.8% w/w aqueous solution) | 2.14 |
| *SYNPROLAM 35 DMO | (30% w/w active aqueous solution of alkyl dimethyl amine oxide marketed by ICI. The alkyl group represents a mixture of chain lengths all containing an odd number of carbon atoms from 13 to 15 inclusive). | 3.67 |
| *PENTRONE ON | (33% active aqueous sodium 2-ethylhexyl sulphate marketed by ABM Chemicals Ltd.) | 0.36 |
| *CHLORIFF 310 | A perfume blend marketed by International Flavours & Fragrances, I.F.F. (Great Britain Ltd). | 0.125 |
| Soft Water | | 27.035 |

The ratio of amine oxide to alkali metal alkyl sulphate was 9.268:1 and the concentration of surfactant blend was 1.22% based upon the active ingredients in the final bleach composition.

The components were mixed in accordance with method I and yielded a thickened hypochlorite bleach composition developing a maximum viscosity of 76 cps., and having Cloud Point 46° C.

The initial viscosity was 58 cps., increasing to 76 cps., on standing. After 21 days storage in the dark at 37° C., which purports to simulate 3 months storage at ordinary temperature the viscosity dropped to 39 cps. By contrast a thickened hypochlorite composition containing nominally 10% available chlorine marketed in the U.K., had starting viscosity 51 cps. which gradually dropped to 27 cps. after storage under the same conditions.

EXAMPLE 2

| | | % age w/w |
|---|---|---|
| Sodium hypochlorite | (15% available chlorine) | 66.67 |
| Sodium hydroxide | (46.8% aqueous NaOH) | 2.14 |
| *HOE S2661 (Marketed by Hoeschst U.K. Limited) | (27% actives aqueous solution of alkyl dimethyl amine oxide in which the alkyl group represents a mixture of chain lengths all containing an even number of carbon atoms from 12 to 16 inclusive, $C_{12}$ predominating). | 2.20 |
| *PETRONE ON | | 0.5 |
| Added sodium chloride | | 2.0 |
| Soft water | | 26.49 |

The concentration of surfactant blend was 0.759% based on active materials in the thickened bleach composition and the ratio of amine oxide to alkali metal alkyl sulphate was 3.6:1.

The components were mixed in accordance with method I and yielded a thickened bleach composition developing a maximum viscosity 62 cps. and had Cloud Point 28° C.

The initial viscosity was 51 cps. rising to 62 cps. on standing. Accelerated storage tests in the dark at 37° C. for 21 days produced a decrease in viscosity to 40 cps.

EXAMPLE 3

| | | % age w/w of active material |
|---|---|---|
| Sodium hypochlorite | (as available chlorine) | 9.86 |
| Sodium hydroxide | | 0.987 |
| *HOE 2661 | | 1.071 |
| *PENTRONE | | 0.211 |
| Sodium chloride | | 2.00 |
| Perfume | (Pine Line by Fritzsche-Dodge & Olcott (UK) Ltd) | 0.148 |
| Soft water | | ad 100.00 |

The level of surfactant blend was 1.28% and the ratio of amine oxide of alkali metal sulphate was 5.076:1.

The components were mixed in accordance with method I with a modification in which firstly the perfume was incorporated into ⅓ part of the amine oxide. The resulting thickened bleach composition developed a maximum viscosity 104 cps. on standing and exhibited Cloud Point 40° C.

On storage in the dark at 37° C. for 21 days the viscosity dropped to 69 cps.

EXAMPLE 4

| | | % age w/w |
|---|---|---|
| Sodium hypochlorite | (15% active) | 66.667 |
| Sodium hydroxide | (46.8%) | 2.140 |
| *SYNPROLAM 35 DMO | (30% active) | 3.136 |
| *EMPICOL LX28 | (28% actives sodium lauryl sulphate manufactured by Albright & Wilson) | 0.306 |
| Perfume | | 0.125 |
| Soft Water | | 27.623 |

*The words SYNPROLAM 35DMO, PENTRONE ON, CHLORIFF 310, HOE S2661 & EMPICOL LX28 are Trade Names.

The level of surfactant blend was 1.026% and the ratio of amine oxide to alkali metal sulphate was 10.93:1.

The components were mixed in accordance with method II and the resulting thickened bleach composition developed a maximum viscosity 105 cps. and had a Cloud Point 35.5° C.

In the following table of Examples the sodium hypochlorite solution, sodium hydroxide solution and perfume were the same as those used in Example 1 and the amine oxide solution was as used in Example 2. The constituents of these compositions were mixed in accordance with the procedure of Method I.

| | Example No. | | | | | | | |
|---|---|---|---|---|---|---|---|---|
| | 1 | 2 | 3 | 4 | 5 | 6 | 7 | 8 |
| Sodium hypochlorite solution | 16.667 | 16.667 | 16.667 | 16.667 | 16.667 | 66.670 | 66.670 | 66.670 |
| Sodium hydroxide solution | 2.140 | 2.140 | 2.140 | 2.140 | 2.140 | 2.140 | 2.140 | 2.140 |
| Amine oxide solution | 5.628 | 8.444 | 7.000 | 5.628 | 7.00 | 1.012 | 1.686 | 1.146 |
| Sodium alkyl sulphate solution | 1.212 | 1.818 | 1.818 | 1.212 | 1.818 | 0.250 | 0.404 | 0.274 |
| Additional sodium chloride | 2.000 | 2.000 | 2.000 | 4.00 | 4.00 | — | 2.000 | 2.000 |
| Perfume | 0.125 | 0.125 | 0.125 | 0.125 | 0.125 | 0.125 | 0.125 | 0.125 |
| Soft water | 72.228 | 68.806 | 70.25 | 70.228 | 68.250 | 29.803 | 26.975 | 27.645 |
| % age active chlorine | 2.5 | 2.5 | 2.5 | 2.5 | 2.5 | 10 | 10 | 10 |
| % age added sodium chloride | 2.00 | 2.00 | 2.00 | 4.00 | 4.00 | — | 2.00 | 2.00 |
| Cloud point in °C. | >70 | >70 | >70 | >70 | >70 | 22.5 | 24 | 19.5 |
| Viscosity @ 20° C. in centipoise | 35 | 69 | 53 | 43 | 69 | 29 | 47 | 37* |
| % age w/w amine oxide | 1.520 | 2.280 | 2.890 | 1.520 | 1.890 | 0.273 | 0.455 | 0.309 |
| % age w/w sodium alkyl sulphate | 0.400 | 0.600 | 0.600 | 0.400 | 0.600 | 0.083 | 0.133 | 0.090 |
| Total surfactant % w/w | 1.920 | 2.88 | 2.49 | 1.92 | 2.49 | 0.356 | 0.588 | 0.399 |
| Ratio amine oxide:alkyl sulphate | 3.8:1 | 3.8:1 | 3.15:1 | 3.8:1 | 3.15:1 | 3.29:1 | 3.42:1 | 3.43:1 |

| | Example No. | | | | | | | |
|---|---|---|---|---|---|---|---|---|
| | 9 | 10 | 11 | 12 | 13 | 14 | 15 | 16 |
| Sodium hypochlorite solution | 66.670 | 66.670 | 66.670 | 46.669 | 46.669 | 46.669 | 33.735 | 33.735 |
| Sodium hydroxide solution | 2.140 | 2.140 | 2.140 | 2.140 | 2.140 | 2.140 | 2.140 | 2.140 |
| Amine oxide solution | 2.675 | 5.35 | 6.796 | 2.675 | 2.675 | 2.675 | 2.814 | 5.628 |
| Sodium alkyl sulphate solution | 0.500 | 0.500 | 0.500 | 0.500 | 0.600 | 0.700 | 0.606 | 1.212 |
| Additional sodium chloride | 2.000 | 2.000 | 2.000 | 2.000 | 2.000 | 2.000 | 2.000 | 2.000 |
| Perfume | 0.125 | 0.125 | 0.125 | 0.125 | 0.125 | 0.125 | 0.125 | 0.125 |
| Soft water | 25.890 | 23.215 | 21.769 | 5.891 | 45.791 | 45.691 | 58.58 | 55.16 |
| % age active chlorine | 10 | 10 | 10 | 7 | 7 | 7 | 5.06 | 5.06 |
| % age added sodium chloride | 2.00 | 2.00 | 2.00 | 2.00 | 2.00 | 2.00 | 2.00 | 2.00 |
| Cloud point in °C. | 40 | >62 | >70 | >40 | >40 | 40 | >70 | >70 |
| Viscosity @ 20° C. in centipoise | 66 | 43 | 37 | 37 | 44 | 53 | 33 | 67 |
| % age w/w amine oxide | 0.722 | 1.444 | 1.835 | 0.722 | 0.722 | 0.722 | 0.760 | 1.520 |
| % age w/w sodium alkyl sulphate | 0.165 | 0.165 | 0.165 | 0.165 | 0.199 | 0.231 | 0.200 | 0.400 |
| Total surfactant % w/w | 0.887 | 1.609 | 2.000 | 0.887 | 0.921 | 0.953 | 0.960 | 1.920 |
| Ratio amine oxide:alkyl sulphate | 4.376:1 | 8.752:1 | 11.12:1 | 4.376:1 | 3.628:1 | 3.125:1 | 3.8:1 | 3.8:1 |

| | Example No. | | | | | | | |
|---|---|---|---|---|---|---|---|---|
| | 17 | 18 | 19 | 20 | 21 | 22 | 23 | 24 |
| Sodium hypochlorite solution | 33.735 | 33.735 | 33.735 | 33.735 | 33.735 | 33.735 | 33.735 | 33.735 |
| Sodium hydroxide solution | 2.140 | 2.140 | 2.140 | 2.140 | 2.140 | 2.140 | 2.140 | 2.140 |
| Amine oxide solution | 8.442 | 2.964 | 1.482 | 4.446 | 2.964 | 1.112 | 3.612 | 3.612 |
| Sodium alkyl sulphate solution | 1.818 | 1.212 | 1.212 | 3.636 | 1.212 | 1.212 | 1.818 | 1.818 |
| Additional sodium chloride | 2.000 | 2.000 | 2.000 | 2.000 | 3.000 | 2.000 | 2.000 | 4.000 |
| Perfume | 0.125 | 0.125 | 0.125 | 0.125 | 0.125 | 0.125 | 0.125 | 0.125 |
| Soft water | 51.74 | 57.824 | 59.306 | 53.918 | 56.824 | 59.676 | 56.57 | 54.57 |
| % age active chlorine | 5.06 | 5.06 | 5.06 | 5.06 | 5.06 | 5.06 | 5.06 | 5.06 |
| % age added sodium chloride | 2.00 | 2.00 | 2.00 | 2.00 | 3.00 | 2.00 | 2.00 | 4.00 |
| Cloud point in °C. | >70 | >70 | >70 | >70 | 37 | >70 | >70 | 26 |
| Viscosity @ 20° C. in centipoise | 144 | 35 | 16 | 21.4 | 43 | 14 | 38 | 45 |
| % age w/w amine oxide | 2.279 | 0.800 | 0.400 | 1.200 | 0.800 | 0.300 | 0.975 | 0.975 |
| % age w/w sodium alkyl sulphate | 0.600 | 0.400 | 0.400 | 1.200 | 0.400 | 0.400 | 0.600 | 0.600 |
| Total surfactant % w/w | 2.879 | 1.200 | 0.800 | 2.400 | 1.200 | 0.700 | 1.575 | 1.576 |
| Ration amine oxide:alkyl sulphate | 3.8:1 | 2:1 | 1:1 | 1:1 | 2:1 | 0.75:1 | 1.625:1 | 1.625:1 |

*Determined @ 18° C.

These examples illustrate that viscosity is influenced by both the concentration of surfactant blend and the ratio of the components of the blend. Further, that in hypochlorite solutions of higher active chlorine content a higher viscosity is achievable for a given concentration of surfactant blend than in a solution of low active chlorine content; but that the Cloud Point is then reduced. To enhance the Cloud Point the concentration of amine oxide may be increased, that is the ratio may be increased without raising the total surfactant concentration.

An increased total surfactant concentration gives rise to increased viscosity. An increase in viscosity may also be attained by the addition of sodium chloride, however, such increased electrolyte concentrations impair the Cloud Point of the final composition.

In some thickened aqueous bleach compositions that are marketed in the U.K. as containing about 10% chlorine it has been observed that the level of available chlorine falls from about 10% to about 6–7% after storage for 3 months at room temperature. The decrease in available chlorine is paralleled in simulated storage tests in 21 days at the slightly elevated temperature of 37° C. Furthermore, the initial viscosity of such compositions is not maintained during the storage period. Reductions in viscosity have been observed in the order of up to one half of the initial viscosity.

The compositions of the present invention exhibit no worse loss of available chlorine or viscosity stability than the compositions discussed immediately above and are generally marginally better from the point of view of viscosity stability in that the viscosity is reduced to about two thirds of the initial viscosity.

What is claimed is:

1. A thickened bleach composition including an aqueous solution of alkali metal hypochlorite, and a thickening amount of a surfactant blend comprising:

(a) an amine oxide of formula:

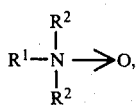

wherein $R^1$ is an alkyl group containing 10 to 18 carbon atoms; $R^2$ is a lower alkyl group containing up to 3 carbon atoms, and (b) an alkali metal alkyl sulphate of formula: $R^3—O—SO_3M$, wherein $R^3$ is an alkyl group containing 8 to 12 carbon atoms and M is lithium, sodium or potassium; the weight ratio of (a) to (b) in said surfactant blend being not less than about 3:4 and said surfactant blend being present in said composition in an amount of at least 0.25% by weight of the total composition.

2. A composition according to claim 1 in which $R^1$ has an odd number of carbon atoms.

3. A composition according to claim 1 in which $R^2$ is methyl.

4. A composition according to claim 1 in which $R^1$ has from 12 to 15 carbon atoms.

5. A composition according to claim 1 in which $R^3$ is a branched chain alkyl group.

6. A composition according to claim 1 in which $R^3$ contains 8 carbon atoms.

7. A composition according to claim 1 in which the alkali metal alkyl sulphate comprises sodium 2-ethylhexyl sulphate.

8. A composition according to claim 1 of viscosity of from 15–150 centipoise.

9. A composition according to claim 8 of viscosity in the range of from 35 to 120 centipoise.

10. A composition according to claim 8 of viscosity in the range of from 60 to 80 centipoise.

11. A composition according to claim 1 including from 0.25% to 3.0% by weight of the total composition of the surfactant blend.

12. A composition according to claim 11 including from 0.7% to 2.0% w/w of the surfactant blend.

13. A composition according to claim 11 including from 0.8% to 1.35% w/w of the surfactant blend.

14. A composition according to claim 1 in which the weight ratio of amine oxide metal alkyl sulphate lies in the range 3:4 to 12:1.

15. A composition according to claim 14 in which the ratio lies in the range 7:2 to 5:1.

16. A composition according to claim 14 in which the ratio lies in the range 4:1 to 23:5.

17. A composition according to claim 1 in which $R^1$ has an odd number of carbon atoms and in which the ratio lies in the range from 8:1 to 12:1.

18. A composition according to claim 17 in which the ratio lies in the range of from 46:5 to 48:5.

19. A composition according to claim 1 of which the Cloud Point is not less than 20° C.

20. A composition according to claim 19 of which the Cloud Point is greater than 30° C.

21. A composition according to claim 1 including alkali metal chloride in addition to that contained in the raw alkali metal hypochlorite.

22. A composition according to claim 21 including up to 5% w/w additional sodium chloride.

23. A composition according to claim 1 including a hypochlorite compatible colourant.

24. A composition according to claim 1 including at least one hypochlorite compatible perfume.

25. A process for the preparation of a composition in accordance with claim 1 comprising the steps of adding the amine oxide to an alkali metal hypochlorite dissolved in water with agitation followed by an alkali metal alkyl sulphate to give the recited ratio of amine oxide and alkali metal alkyl sulphate then allowing the mixture to stand for up to 48 hours to produce a thickened solution.

26. A process for the preparation of a composition in accordance with claim 1 which comprises the steps of mixing the alkali metal alkyl sulphate with the amine oxide in aqueous medium with agitation to form a homogeneous mixture followed by addition of the alkali metal hypochlorite with agitation and then allowing the mixture to stand for up to 48 hours to produce a thickened hypochlorite solution.

* * * * *